US007641599B2

(12) United States Patent
Yoshida et al.

(10) Patent No.: US 7,641,599 B2
(45) Date of Patent: Jan. 5, 2010

(54) EXERCISE THERAPY DEVICE

(75) Inventors: Keizo Yoshida, Tokyo (JP); Takuya Hayashi, Tokyo (JP); Mitsunobu Yoshida, Tokyo (JP)

(73) Assignee: Mitsubishi Electric Engineering Company, Limited, Tokyo (JP)

( * ) Notice: Subject to any disclaimer, the term of this patent is extended or adjusted under 35 U.S.C. 154(b) by 349 days.

(21) Appl. No.: 10/599,782

(22) PCT Filed: Apr. 27, 2004

(86) PCT No.: PCT/JP2004/006083

§ 371 (c)(1),
(2), (4) Date: Oct. 10, 2006

(87) PCT Pub. No.: WO2005/105222

PCT Pub. Date: Nov. 10, 2005

(65) Prior Publication Data

US 2007/0275831 A1 Nov. 29, 2007

(51) Int. Cl.
*A63B 22/06* (2006.01)

(52) U.S. Cl. ..... 482/57; 482/63; 482/4

(58) Field of Classification Search ..... 482/57; 701/51; 474/28; 180/206; 73/854
See application file for complete search history.

(56) References Cited

U.S. PATENT DOCUMENTS

| | | | | |
|---|---|---|---|---|
| 4,221,275 | A * | 9/1980 | Pennebaker et al. | 180/206 |
| 6,174,254 | B1 * | 1/2001 | Tsai | 474/69 |
| 6,436,004 | B1 * | 8/2002 | Loffler et al. | 477/45 |
| 6,443,873 | B2 | 9/2002 | Suzuki | |
| 6,494,798 | B1 * | 12/2002 | Onogi | 474/28 |
| 6,757,603 | B2 * | 6/2004 | Nozaki | 701/51 |
| 6,964,203 | B2 * | 11/2005 | Crasset | 73/854 |
| 7,174,245 | B2 * | 2/2007 | Ries-Mueller et al. | 701/51 |

FOREIGN PATENT DOCUMENTS

| | | |
|---|---|---|
| JP | 2000-95177 | 4/2000 |
| JP | 2001-299957 | 10/2001 |

* cited by examiner

*Primary Examiner*—Jerome Donnelly
(74) *Attorney, Agent, or Firm*—Leydig, Voit & Mayer, Ltd.

(57) ABSTRACT

An exercise therapy device includes pedals, a pedal rotation shaft connected to the pedals, a load motor for driving the pedal rotation shaft, and a load control device for controlling the load motor to cause rotating motion of the pedal rotation shaft to be started by the load motor.

2 Claims, 3 Drawing Sheets

EXERCISE THERAPY DEVICE

TECHNICAL FIELD

The present invention relates to an exercise therapy device and, in particular, to an exercise therapy device which enables an exerciser, whose legs depress the pedals with an extremely low strength, to undergo an exercise therapy without receiving any abrupt load at the start of the exercise therapy when the exercise therapy is conducted, for example, on a patient with heart disease or a patient with a cerebrovascular disorder by using an ergonomic bicycle.

BACKGROUND ART

FIG. 3 is a schematic view of a conventional exercise therapy device as disclosed, for example, in JP 62-46193 B. As shown in FIG. 3, in the conventional exercise therapy device, there are provided a pulley 1 connected with pedals 2 to be depressed by the exerciser and a motor 7 for imparting a load to the pedals 2. Between the pulley 1 and the motor 7, there is provided a pulley 3. A belt 4 is looped around the pulley 1 and the pulley 3. Further, a pulley 5 is provided beside the pulley 3. The pulley 3 and the pulley 5 share the same rotation shaft. A belt 6 is looped around the pulley 5 and the motor 7. Magnets 8 and 9 are mounted to the pulley 1 and the pulley 5, respectively. Further, there are provided Hall elements 10 and 11 for detecting the magnets 8 and 9, respectively. That is, the Hall elements 10 and 11 are situated such that when the magnets 8 and 9 rotate with the pulley 1 and the pulley 5 to reach predetermined positions (the lowest positions of FIG. 3), they are opposed to the Hall elements 10 and 11, so upon each rotation, the magnets 8 and 9 are detected by the Hall elements 10 and 11, whereby it is possible to detect the number of times that each of the pulley 1 and the pulley 5 has rotated. Connected to the Hall elements 10 and 11 is a computer 12, to which signals from the Hall elements 10 and 11 are input, whereby the RPM (Revolution Per Minute) (or the number of revolution) of each of the pulley 1 and the pulley 5 is calculated. Connected to the computer 12 is a load control device 13 for controlling the motor 7, and the load of the motor 7 is controlled based on the RPM supplied from the computer 12.

Next, the operation of the device will be described.

The rotation of the pedals 2 is transmitted to the pulley 5 through the belt 4 looped around the pulley 1 and the pulley 3 to thereby effect an increase in speed, and is further transmitted to the motor 7 through the belt 6. Upon each rotation of the pulley 1 and the pulley 5, the Hall elements 10 and 11 output pulse signals to the computer 12. The computer 12 calculates the number of the pulse signals, and outputs it to the load control device 13. The load control device 13 determines the RPM based on the number of pulse signals to thereby control the load of the motor 7. Further, it is possible to detect the phase angle of the pedals 2 from the RPM, so also when the load is to be set in correspondence with the rotating angle position of the pedals 2, it is possible to effect load setting for each rotating angle position of the pedals 2 by using the RPM.

In the conventional exercise therapy device constructed as described above, at the start of an exercise therapy, the exerciser is required to exert a force larger than a frictional load of a drive system of the exercise therapy device before exerciser can start depressing the pedals 2. Thus, when the strength with which the exerciser depresses the pedals 2 is extremely low, the exerciser receives an abrupt load at the start of the exercise therapy.

It should be noted, however, that when an exercise therapy is to be performed, in particular, on an exerciser whose muscular strength (e.g., the strength of quadriceps femoralis and coxal extensor group) has been markedly reduced, a patient with a heart disease, a patient with a cerebrovascular disorder, or an aged person, it is necessary for the pedal rotating motion to be executed with a particularly small load.

In this way, in the conventional exercise therapy device, at the start of an exercise therapy, the exerciser is required to exert a force equal to or larger than the frictional load of the drive system before he or she can cause the pedals to begin to rotate. Thus, in a case in which an exerciser whose muscular strength has been reduced, such as a physically handicapped person or an aged person, performs exercise with the exercise therapy device, there is a problem in that the pedal load at the start of the operation constitutes a considerable load for the exerciser.

DISCLOSURE OF THE INVENTION

The present invention has been made in view of the above-mentioned problem in the prior art. It is an object of the present invention to provide an exercise therapy device which, when a pedal rotating motion is to be started, can make the pedal load as small as possible.

The present invention provides an exercise therapy device, including: pedals; a pedal rotation shaft connected with the pedals; a load motor for rotation-driving the pedal rotation shaft; and a load control means for controlling the load motor so as to cause a rotating motion of the pedal rotation shaft to be started by the load motor.

Thus, in the exercise therapy device of the present invention, the load control means starts the rotating motion of the pedal rotation shaft, so, when starting the pedal rotating motion, it is possible to make the pedal load as small as possible, whereby even an exerciser with a low physical strength can easily start the pedal rotating motion, making it possible to recover the exercise function and maintain the physical strength of the exerciser.

BEST MODE FOR CARRYING OUT THE INVENTION

Embodiment 1

Figure 1:
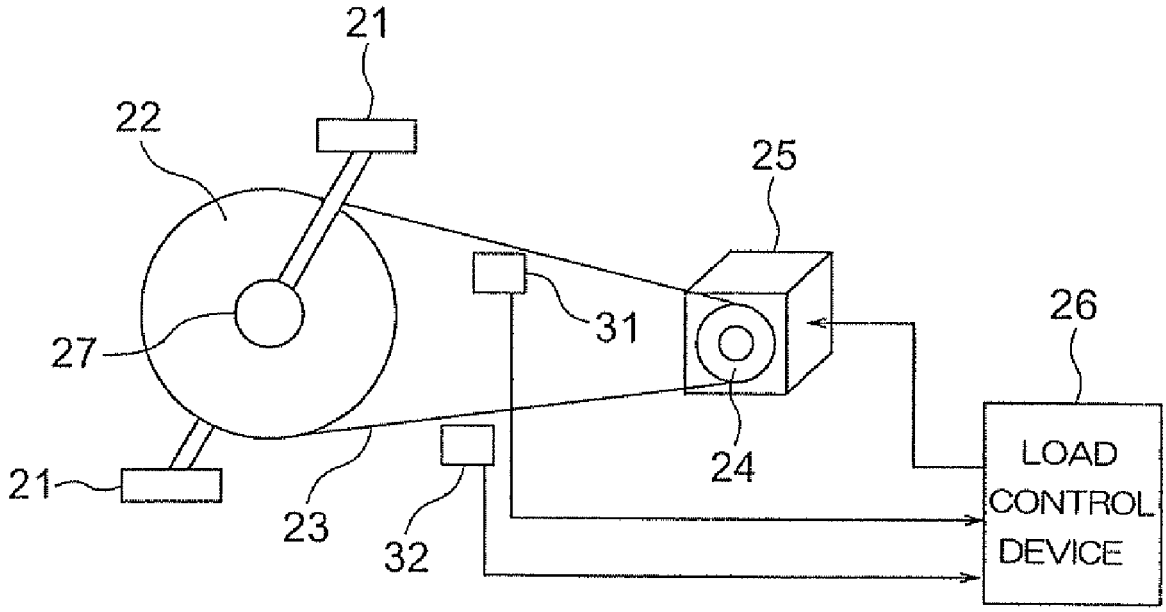
FIG. 1 is a block diagram showing an exercise therapy device according to Embodiment 1 of the present invention.

FIG. 1 is a block diagram showing the overall construction of an exercise therapy device according to Embodiment 1 of the present invention. As shown in FIG. 1, in the exercise therapy device of this embodiment, there is provided a pedal shaft pulley 22 connected with a rotation shaft 27 of pedals 21. Further, there is provided a load motor 25 for effecting a rotating motion of the pedal rotation shaft 27 of the pedals 21. Further, a load side pulley 24 is connected with the load motor 25. A belt 23 is looped around the pedal shaft pulley 22 and the load side pulley 24. The belt 23 constitutes a drive transmission means for transmitting the rotating motion of the pedal rotation shaft 27 to the load motor 25. Further, connected to the load motor 25 is a load control device 26 for drive-controlling the load motor 25. With this construction, the pedal shaft pulley 22 transmits a rotating motion through the belt 23 to the load motor 25 connected with the load side pulley 24, and the load motor 25 is drive-controlled by the load control device 26.

Further, there are provided a detector 31 for detecting a sag on the upper side of the belt 23 and a detector 32 for detecting a sag on the lower side of the belt 23, and sag detection signals from the detectors 31, 32 are input to the load control device 26.

The detectors 31, 32 consist, for example, of optical sensors, proximity sensors, distance sensors, etc. Further, through incorporation of idlers that are vertically movable according to the tension and sag of the belt 23, it is also possible to form the detectors by using limit switches, position sensors, etc. apart from the above-mentioned sensors.

As described below, the belt 23 sags at the time of start, etc., and the vertical positional deviation of the belt 23 due to the sag is predictable at the time of design or production from the material, length, etc. of the belt 23. Thus, the detectors 31 and 32 are provided at positions where detection is possible only when the belt 23 sags. That is, when the belt 23 sags, the belt 23 enters the detection-possible area of the detectors 31 and 32; normally, the belt 23 is not detected by the detectors 31 and 32.

When the exerciser rotates the pedals in the normal direction, and the load motor 25 constitutes the load, the belt 23 is tense on the upper side and sags on the lower side. On the other hand, when the pedals are caused to rotate in the normal direction by the assisting force of the load motor 25, the belt 23 sags on the upper side and is tense on the lower side.

By utilizing this property, it is possible to make a judgment by the detectors 31, 32 as to whether the pedal rotation shaft 27 is being rotated by the assisting force due to the load motor 25 or not (judgment means).

Figure 2:
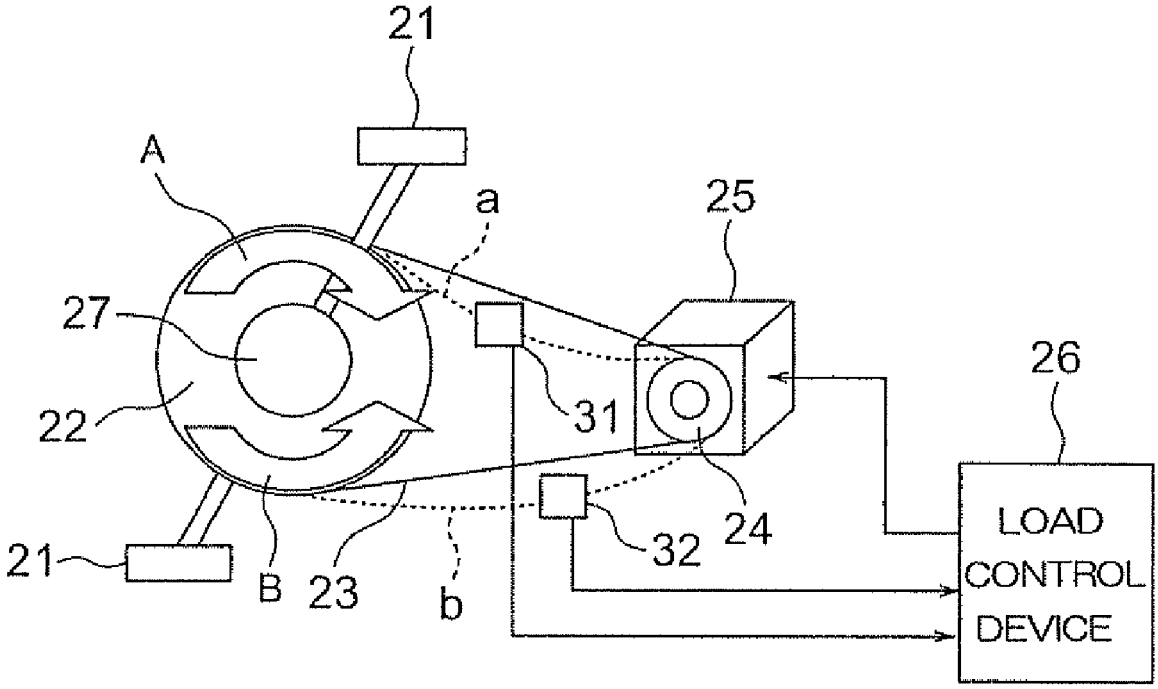
FIG. 2 is an explanatory view showing an example of how a sag is detected in the exercise therapy device of Embodiment 1 of the present invention.

That is, when the detector 31 detects the belts 23, as shown in FIG. 2, it is determined that the pedals are being rotated by the assisting force of the motor (broken line "a"), and when the detector 31 does not detect the belt 23, it is determined that the pedals are being rotated by the exerciser (solid line).

In the same way, when the detector 32 detects the belt 23 as shown in FIG. 2, it is determined that the pedals are being rotated by an exerciser (solid line), and when the detector 32 does not detect the belt 23, it is determined that the pedals are being rotated by the assisting force of the motor 25 (broken line "b").

Figure 3:
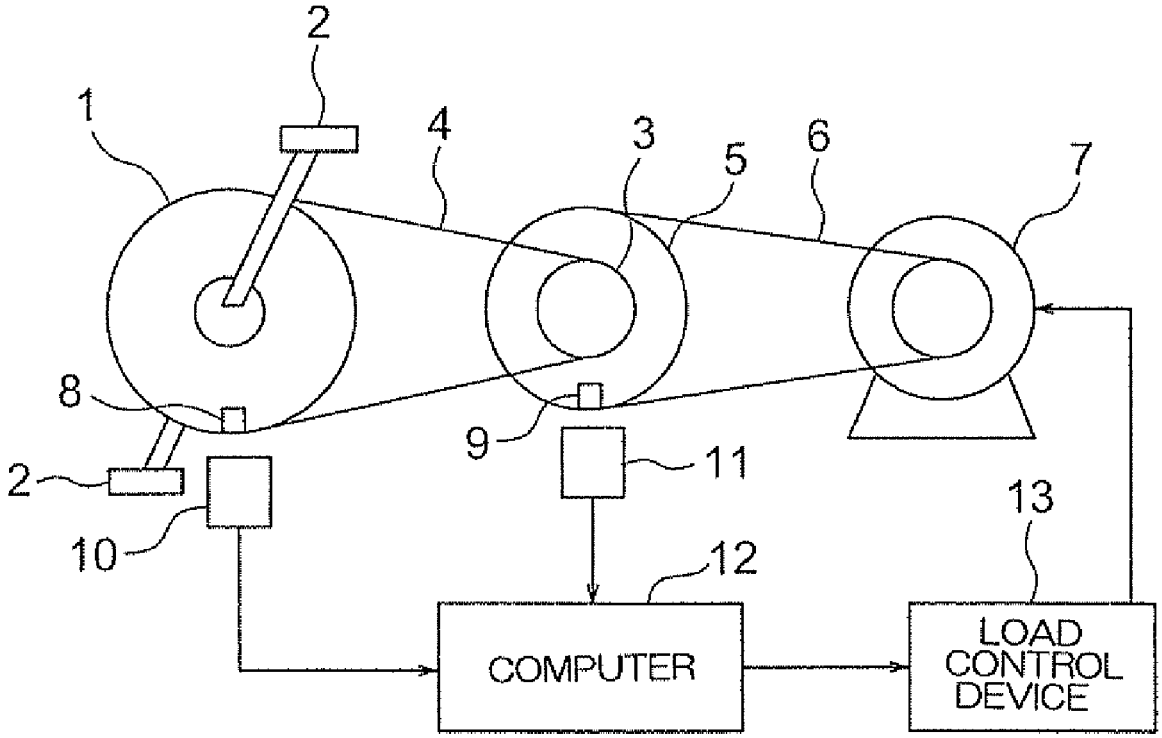
FIG. 3 is a schematic view of a conventional exercise therapy device.

As shown, for example, in JP 62-46193 B (FIG. 3), regarding the overall construction of the exercise therapy device of this embodiment is composed of a handle for the exerciser to grip during exercise, a saddle for the exerciser to sit on, a frame accommodating the pedal shaft pulley 22, the load motor 25, etc., and a stand supporting them.

Next, an operation of the exercise therapy device shown in FIG. 1 will be described with reference to FIG. 2.

As shown in FIG. 2, in a case in which the exerciser performs exercise by depressing the pedals 21 to rotate the pedal rotation shaft 27 in the direction of an arrow B, when the exerciser starts to depress the pedals 21 in the direction B, the lower portion of the belt 23 sags as indicated by the broken line "b" due to the tension generated. The detector 32 detects the sag, and outputs a sag detection signal. Based on the sag detection signal, the load control device 26 drives the load motor 25 so as to rotate the load motor 25 in the direction B. As a result, the load motor 25 is driven so as to assist the force with which the exerciser rotates the pedals 21. Owing to the assisting operation of the load motor 25, the exerciser can start the pedal rotating motion with a small force.

When the pedal rotating motion is further continued, and the load control device 26 drives the load motor 25 faster than the rotating speed of the pedals 21, the upper portion of the belt 23 sags as indicated by the broken line "a" owing to the tension generated, so the detector 31 detects the sag, and outputs a sag detection signal. Based on the sag detection signal, the load control device 26 operates so as to stop the load motor 25, whereby the assisting operation of the load motor 25 is stopped.

When the pedals are rotated in a direction A, the above-mentioned operations are completely reversed.

That is, as shown in FIG. 2, in a case in which the exerciser performs an exercise by depressing the pedals 21 to rotate the pedal rotation shaft 27 in the direction A, when the exerciser starts to depress the pedals 21 in the direction A, the upper portion of the belt 23 sags as indicated by the broken line "a" owing to the tension generated. The detector 31 detects the sag, and outputs a sag detection signal. Based on the sag detection signal, the load control device 26 drives the load motor 25 so as to rotate the load motor 25 in the direction A. As a result, the load motor 25 is driven so as to assist the force with which the exerciser rotates the pedals 21. Owing to the assisting operation of the load motor 25, the exerciser can start the pedal rotating motion with a small force.

When the pedal rotating motion is further continued, and the load control device 26 drives the load motor 25 faster than the rotating speed of the pedals 21, the lower portion of the belt 23 sags as indicated by the broken line "b" owing to the tension generated, so the detector 32 detects the sag, and outputs a sag detection signal. Based on the sag detection signal, the load control device 26 operates so as to stop the load motor 25, whereby the assisting operation of the load motor 25 is stopped.

As described above, in this embodiment, by repeating the operations, it is possible to maintain a state in which, when the pedals 21 are about to be depressed, the pedals 21 are kept at rest at the limit of rotation-stop, so when he or she starts to depress the pedals 21, the exerciser can start the exercise in a state in which the load is substantially zero.

Further, with the above-mentioned construction, when the pedals 21 are not being depressed, it is possible to keep the pedals 21 at rest at the limit of rotation-stop, so the when the exerciser starts to depress the pedals 21, he or she can reliably start the exercise in a state in which the load is substantially zero.

In this way, in this embodiment, an assisting operation is effected by the load motor 25 when the exerciser starts the pedal rotating motion, so even when the muscular strength of the exerciser is extremely low, it is possible to start the exercise therapy with ease.

Further, according to the present invention, it is also possible to integrate a conventional muscular strength measuring device with a conventional bicycle type exercise therapy device, there by making it possible for various exercisers to perform exercise without overexerting themselves.

According to the present invention, also in an exercise load test, the exercise load can gradually increase from a state in which the load is substantially zero, so it is possible to realize an accurate exercise load test.

According to the present invention, even an exerciser whose physical strength or leg strength is low can perform exercise without overexerting himself or herself.

While, in the above-mentioned embodiment of the present invention, an exercise is performed with the legs by using an ergonomic bicycle, it goes without saying that the exerciser can perform an exercise from a state in which the load is significantly small by adopting the same mechanism even in the case of an exercise therapy for legs, arms, etc.

While, in the above-mentioned embodiment of the present invention, two detectors are used, it goes without saying that the detection can be performed with the detector 32 alone, thus simplifying the control.

While, in the above-mentioned embodiment of the present invention, a sag in a belt is detected as a sag of the transmission mechanism of the drive system, it goes without saying that, apart from a belt, the present invention is also applicable to any mechanism as long as it is one generating a sag in a drive transmission system, such as a chain, a V-belt, or a timing belt.

While, in the above-mentioned embodiment of the present invention, a load motor is used, it goes without saying that, apart from a load motor, other assist drive mechanisms, such as a dedicated assist motor, will help to achieve the same effect.

The invention claimed is:

1. An exercise therapy device comprising:

a rotatable pedal shaft pulley;

pedals connected to the pedal shaft pulley for rotating the pedal shaft pulley upon application of a force to the pedals by a user using the exercise therapy device;

a load motor coupled to the pedal shaft pulley for supplying an assisting force assisting the user in rotating the pedal shaft pulley;

a transmission, including a load side pulley and an endless belt, coupling the load motor to the pedal shaft pulley and transmitting a driving force applied to the pedals by the user in rotating the pedal shaft pulley to the load motor, and transmitting the assisting force from the load motor to the pedal shaft pulley;

a sag detector detecting sag in the endless belt and outputting a sag detection signal in response to detection of sag in the endless belt; and a load control device determining, in response to the sag detection signal, whether rotation of the pedal shaft pulley is being effected by the force applied by the user to the pedals or by an assisting force supplied by the load motor, and controlling the load motor by activating the load motor to produce an assisting force when the force applied by the user, in beginning rotation of the pedal shaft pulley, is rotating the pedal shaft pulley, and by stopping the load motor when the assisting force is turning the pedal shaft pulley so that the pedal shaft pulley rotates faster than the rotating speed of the pedal shaft pulley produced by the force applied to the pedals by the user.

2. The exercise therapy device according to claim 1, wherein the endless belt includes an upper portion extending between the load motor and the pedal shaft pulley, and a lower portion extending between the pedal shaft pulley and the load motor, and below the upper portion, the sag detector includes a first sag detector for detecting sag of the upper portion of the endless belt and a second sag detector for detecting sag of the lower portion of the endless belt, and the load control device is responsive to both of the first and second sag detectors so that the assisting force can be supplied and stopped regardless of direction of rotation of the pedal shaft pulley.

* * * * *